United States Patent [19]

Soucie

[11] 4,055,344

[45] Oct. 25, 1977

[54] ROTATING MAZE GAME DEVICE

[76] Inventor: Claude Soucie, 6807 60th St., Ridgewood, N.Y. 11227

[21] Appl. No.: 686,458

[22] Filed: May 14, 1976

[51] Int. Cl.[2] ..... A63B 71/04; A63F 5/02; A63F 7/02

[52] U.S. Cl. ..... 273/110; 273/128 R; 273/126 R; 273/123 R

[58] Field of Search ..... 248/456; 273/110, 115, 273/116, 117, 120 R, 120 A, 123 R

[56] References Cited

U.S. PATENT DOCUMENTS

| | | | |
|---|---|---|---|
| 289,394 | 12/1883 | Danner | 248/456 |
| 1,990,859 | 2/1935 | Elliott | 273/110 |
| 2,601,985 | 7/1952 | Yerkes | 273/120 R |
| 2,742,291 | 4/1956 | Simon | 273/113 |
| 2,910,296 | 10/1959 | Irwin | 273/123 R |
| 3,328,033 | 6/1967 | Hendry | 273/127 R |
| 3,638,945 | 2/1972 | Breslow | 273/1 R |
| 3,655,191 | 4/1972 | Grant | 273/1 R |

FOREIGN PATENT DOCUMENTS

| | | | |
|---|---|---|---|
| 1,953,186 | 1971 | Germany | 273/110 |
| 417,576 | 1934 | United Kingdom | 273/109 |

*Primary Examiner*—Richard C. Pinkham
*Assistant Examiner*—Lawrence E. Anderson
*Attorney, Agent, or Firm*—Richard L. Miller

[57] ABSTRACT

A game device which has the features of an inclined maze through which a ball or other object is left to roll or travel and which is diverted from a straight course by obstructions in the maze so that by chance or skill it leaves the maze into any one of several different scoring pockets, and the maze being rotatable so as to additionally confound the travel course.

2 Claims, 4 Drawing Figures

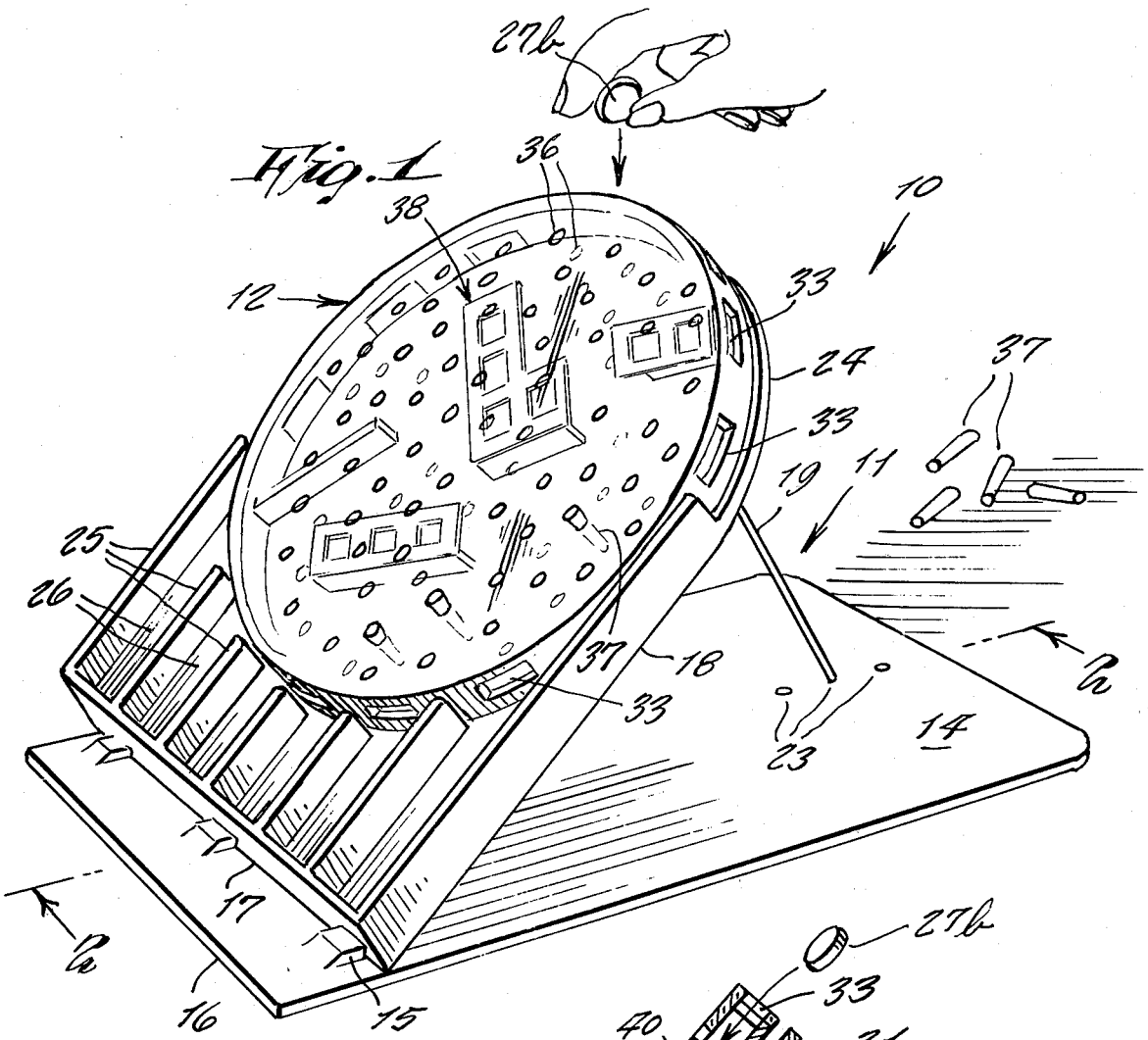
Fig. 1
27b
36
38
10
12
33
24
37
33
11
19
25
26
37
18
33
23
14
17
16
15
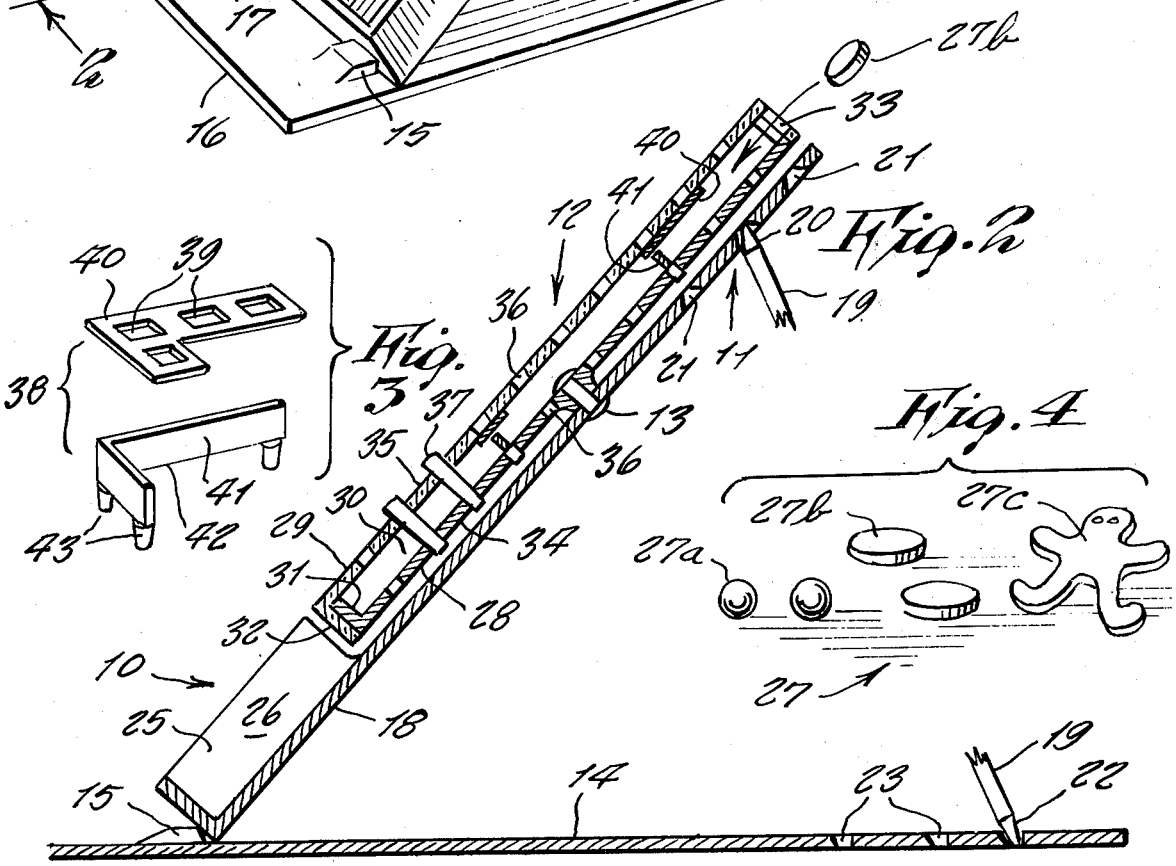
27b
33
40
21
41
12
20
Fig. 2
19
36
21
11
13
37
36
35
30
29
34
31
28
32
10
26
25
18
15
14
23
19
22
40
39
38
Fig. 3
41
43
42
Fig. 4
27b
27c
27a
27

ROTATING MAZE GAME DEVICE

This invention relates generally to game devices of the type known as pin ball games in which a ball rolls down an inclined plane through a maze that either catches or diverts the ball's travel course.

A principal object of the present invention is to provide a maze game device in which the inclined maze is additionally manually controlled by a player so as to rotate about an inclined vertical axis in order that various different obstructions throughout the maze may possibly be dodged or struck selectively in front of a rolling ball so as to either avoid or intercept a normal travel course of the ball, and thereby attempt to control the ball to get to a desired goal.

Another object is to provide a rotating maze game device wherein the maze has a plurality of entrances for a ball and exits from the maze, and wherein the maze includes pockets for hiding and scoring of playing pieces.

Yet another object is to provide a rotating maze game device that can be used for a "copper and robber" game in which certain playing pieces are attempted to "catch" other playing pieces while moving through the maze, and wherein the maze obstructions may be in the form of houses or other hideouts behind which a playing piece may become lodged while others pursue him, and wherein opaque areas have windows at random therein so as to allow momentary observation of the moving playing pieces, giving the effect of "now you see him, now you don't" which adds excitement to the game.

Another object is to provide a rotating maze game device through which pins can be inserted selectively at any place so as to provide additional obstructions to the playing pieces that travel in the maze, so that the maze may be made more complex, as desired.

Still another object is to provide a rotating maze game device which accordingly by being selectively rotatable in either direction during a game becomes a game of skill instead of only a game of chance.

Other objects are to provide a rotating maze game device which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 1 is a front perspective view of the invention, and showing extra pins not in use.

FIG. 2 is a cross section on line 2—2 of FIG. 1.

FIG. 3 is a detail of a mask and a baffle associated therewith.

FIG. 4 is a view of various types of playing pieces used.

Referring now to the drawing in detail, the reference numeral 10 represents a rotating maze game device according to the present invention, wherein there is easel 11 upon which a circular maze 12 is rotatably secured by means of a central rivet 13.

The easel 11 consists of a horizontal, flat base panel 14 having upstanding toes or stops 15 near a forward end 16 so a lower corner edge 17 of an inclined panel 18 rests thereagainst; the panel 18 being maintained inclined at different selected angles by means of a brace 19 having a pointed upper end 20 inserted in any one of tapered openings 21 in the upper portion of the inclined panel, and a pointed lower end 22 inserted in any one of the row of tapered openings 23 on a rear end of the base panel.

The upper end of the inclined panel is rounded as shown at 24 so as to align with the circular maze edge. A lower portion of the inclined panel has a series of parallel spaced apart walls 25 on its upper side that form goal compartments 26 therebetween, and into which playing pieces 27 (which are used to travel through the maze) will drop after passage therethrough.

The playing pieces may be of any shape as shown in FIG. 4, and may be either a spherical ball 27*a,* circular disc 27*b* or of any irregular shape such that of a man 27C.

The maze 12 consists of a flat, circular, housing consisting of a case 28 and transparent cover 29 that snap fits on top thereof so as to form a circular compartment 30 therebetween. The side walls 31 and 32 of the case and cover respectively have a series of aligned openings 33 therethrough that serve as entrances and exits for the playing pieces. The circular walls 34 and 35 of the case and cover respectively are each perforated throughout their entire areas with openings 36 which align with each other so that tapered pins 37 can be inserted therethrough so that obstructions can thus be produced at any desired place for the playing pieces travelling through the maze. The openings 36 in the case are slightly smaller than the openings 36 in the cover so as to hold the pins from falling through.

Additionally, obstructions can be inserted into the maze compartment 30 which are in the shape of houses 38 having windows 39. These houses may be made in various shapes and sizes as shown in FIG. 1, and consist of a top panel 40 securable by adhesion to an underside of housing upper side wall 32, and a separate side wall 41 which can be aligned or disaligned with an edge of the top panel 40, as shown in FIG. 1. The wall may be L-shaped, U-shaped, straight walled or any other shape as indicated, and the top panel may be of a same or dis-similar size and shape to suit the same. For each house there may be more or less openings to form windows 39. The top panel 40 is opaque and includes adhesion means on its upper side. A lower edge 42 of the walls 40 are integral with downward extending pegs 43 for insertion into the openings 36 of the case circular bottom wall 31, so as to support the house side wall in desired locations inside the maze.

In operative use, the device may be used in any of different games. In one game the playing pieces deposited through entrances (as shown in FIG. 1) simply travels through the maze and outward of exits into the goal compartments 26 each of which is marked with a different scoring value. The maze may be retained either stationary or may be made allowable to be rotated during a game.

In one particular game of "coppers and robbers" several playing pieces are deposited in a same game, some of which represent robbers and the other of which represent police chasing the robbers to capture them. At times they will become hidden from view to a player by lodging in corners of L-shaped or U-shaped walls of houses 38 and they may become momentarily seen passing a window 39 of the houses, thus allowing a player, rotating the maze to either bring police and robbers together or separate. The game may be played with various rules and may be made to be played either by a single player, or two players one of which represents the police and the other the robbers so that one attempts to attain a capture and the other an escape. Robbers falling together with police into a single goal compartment 26 can be regarded as captured, while robbers falling into a goal compartment alone without any police playing piece may be regarded as having escaped. Thus numerous different games may be played, each with its own established rules.

Thus there is provided a novel rotating maze game device.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A rotating maze game device, comprising in combination, an easel, a rotatable maze supported pivotally thereupon, and playing pieces for travel through said maze; wherein said easel comprises a horizontal base panel, an inclined panel supported at an inclined angle upon said base panel by means of a brace, and means for adjusting said inclined angle; wherein said maze comprises a circular housing supported pivotally free at the center upon a pivot secured upon said inclined panel, said housing comprising a case and transparent cover that snap fit together for easy opening, to form a central compartment, side walls of said case and cover having aligned openings serving as entrances and exits for said playing pieces, and aligned openings in upper and lower sides of said housing for supporting obstructions in selective positions inside said housing compartment for said playing pieces; wherein certain said obstructions comprise adjustable taper pins; wherein other of said obstructions comprise houses each of which consists of a side wall of any straight or bent shape and a separate opaque top wall having window openings therethrough, a lower edge of said house side walls having downward extending pegs for insertion into said opening through said lower side of said housing, while said opaque top wall is adherred to an underside of said housing top wall.

2. The combination as set forth in claim 1 wherein a lower portion of said inclined panel is divided by upstanding spaced apart walls into a plurality of goal compartments, an upper end of which align with said side openings of said maze housing, each said goal compartment being indicated with a numerical scoring value.

* * * * *